United States Patent [19]

Pachmayr et al.

[11] 4,132,024

[45] Jan. 2, 1979

[54] CUSHIONED PISTOL GRIP

[75] Inventors: Frank A. Pachmayr, Los Angeles; Jack R. Farrar, Whittier, both of Calif.

[73] Assignee: Packmayr Gun Works, Inc., Los Angeles, Calif.

[21] Appl. No.: 838,805

[22] Filed: Oct. 3, 1977

[51] Int. Cl.[2] ..... F41C 23/00

[52] U.S. Cl. ..... 42/71 P; 42/74

[58] Field of Search ..... 42/71 D, 74

[56] References Cited

U.S. PATENT DOCUMENTS

| | | | |
|---|---|---|---|
| 1,049,739 | 1/1913 | Leach, Jr. | 42/71 P |
| 3,672,084 | 6/1972 | Pachmayr | 42/71 P |
| 3,815,270 | 6/1974 | Pachmayr | 42/71 P |
| 4,043,066 | 8/1977 | Pachmayr | 42/71 P |

*Primary Examiner*—Charles T. Jordan

*Attorney, Agent, or Firm*—William P. Green

[57] ABSTRACT

A piston grip including a body formed at least partially from elastomeric material and having two side portions to be received at opposite sides of a revolver handle, and a cross strap portion connected permanently to the side portions at rear edges thereof to extend across the back of the pistol handle. The side portions may have flanges projecting inwardly from their forward edges to be received in front of the piston handle. Relatively stiff reinforcing elements are provided in the side portions of the body, and flexible reinforcing fabric or other material is provided in the cross strap portion.

18 Claims, 7 Drawing Figures

CUSHIONED PISTOL GRIP

BACKGROUND OF THE INVENTION

This invention relates to improved pistol grips to be applied to and extend about the handle of a pistol for cushioning the contact between the grip and a user's hand.

There is shown in U.S. Pat. No. 3,672,084 a grip adapted to be applied to the handle of a revolver type gun, and which grip is formed as two sections secured to opposite sides of the revolver handle and meeting one another in a central plane of the grip. U.S. Pat. No. 3,815,270 shows another type of grip in which two opposite side sections are connected together by a strap which extends across the front of the pistol handle. Another type of pistol grip is shown in U.S. patent application Ser. No. 693,424 filed June 7, 1976 on "Pistol Grip", now U.S. Pat. No. 4,043,066.

SUMMARY OF THE INVENTION

The grip arrangements of the present invention are in some respects similar to the device of the above mentioned U.S. Pat. No. 3,672,084, but have the advantage of providing a better and more reliably close fit and tight retention of the grip structure on the pistol handle, while at the same time desirably completely enveloping the sides, front and back of the pistol handle with cushioning material. Further, the grips of the invention are very easily applied to a pistol handle, and are constructed to minimize any difficulties which might otherwise be encountered in bringing opposed inner edges of opposite side portions of the grip assembly into properly meeting contact with one another.

A grip unit constructed in accordance with the invention includes a body which is molded to form two opposite side portions or sections adapted to be received at opposite sides of a pistol handle, and a cross strap portion which is secured permanently to and connects together the two opposite side portions of the body at their rear edges. The cross strap is adapted to extend across and cover the back of the pistol handle, to present a continuous uninterrupted outer surface at the back of the pistol handle for cushioning engagement with the user's hand. The outer surfaces of the opposite side portions and the rear cross strap are all desirably formed of elastomeric material to attain the desired cushioning action. At the front of the grip, at least one of the side portions, and preferably both of them, have a flange extending inwardly toward the other side of the device and to a position in front of the pistol handle to engage the handle at that location in a manner assisting in pulling the cross strap at the back of the handle tightly against the gun. The entire grip may then be retained on the pistol handle by a fastener or fasteners holding the opposite side portions inwardly against the handle.

The side portions of the grip body preferably contain reinforcing elements, desirably taking the form of rigid reinforcing plates or hard rubber layers at the inner side of the elastomeric material. The cross strap is also reinforced, but by a flexible element, which may be a reinforcing fabric. The interconnection between the cross strap and the side portions may be enhanced, both during the molding operation and subsequently thereto, by connecting the fabric or other flexible reinforcing material of the cross strap at its opposite edges to the reinforcing plates or other reinforcing elements of the side portions of the body, as by provision of hooks or other projections on the plates adapted to extend through opposite edge portions of the fabric.

The back surface of the pistol handle is normally convexly curved or rounded as viewed in horizontal section. Best results are achieved in the present invention, however, by desirably forming the rear cross strap portion to, in an initial condition, be uncurved or straight in horizontal section, with the flanges at the front of the device in that initial condition being spaced slightly apart, in a relation such that when the rear cross strap is ultimately curved about the back surface of the handle the opposed inner edges of the flanges are brought closer together and desirably into contact with one another.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
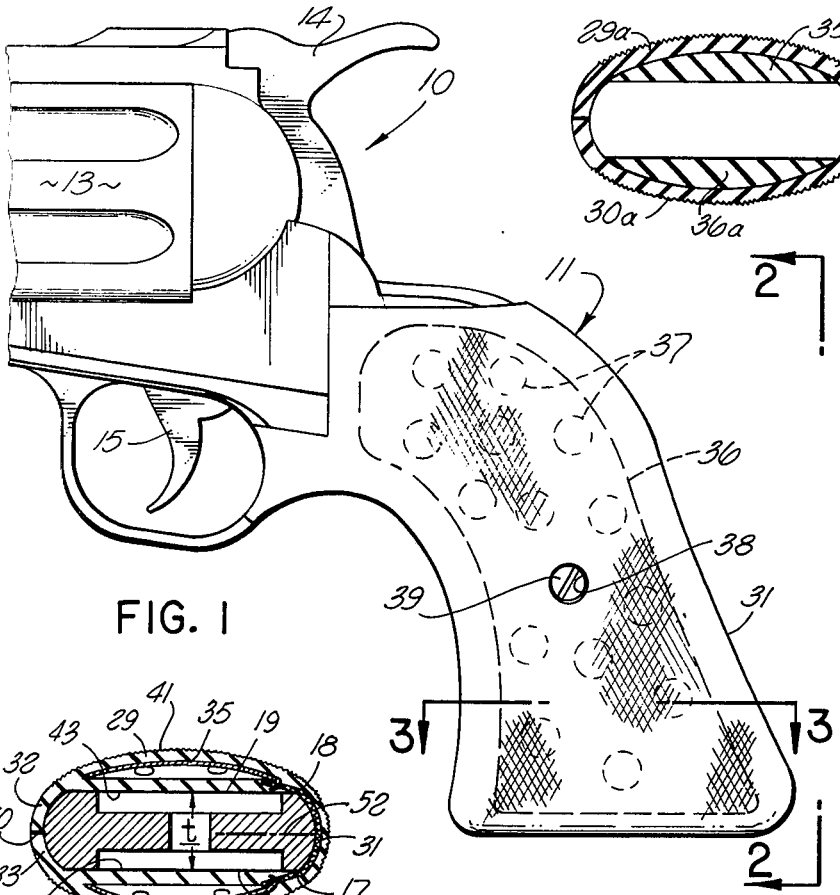
FIG. 1 is a fragmentary side view of a revolver having a cushioning grip constructed in accordance with the invention.
Figure 3:
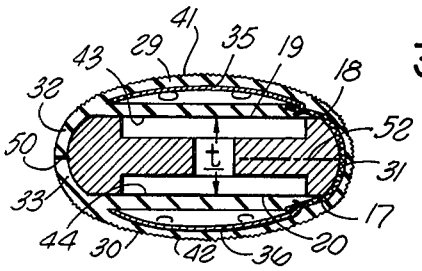
FIG. 3 is an enlarged horizontal section taken on line 3—3 of FIG. 1.

FIG. 1 represents fragmentarily at 10 a conventional revolver having a resilient grip device 11 formed in accordance with the invention mounted on its handle portion 12. The gun includes the usual revolving cylinder 13 for containing a series of cartridges adapted to be fired by a hammer 14 under the control of a trigger 15. To describe the handle 12 with sufficient detail to enable a full understanding of the structure of the present grip 11, this handle, which is normally cast from a single piece of metal shaped to the configuration illustrated in FIG. 4, may have a rear surface 16 which, as seen in FIG. 3, is rounded in horizontal section from the location 17 to the location 18 of FIG. 3. The opposite side surfaces 19 and 20 of handle 12 may be considered as planar and parallel to one another and as disposed vertically in the FIG. 1 normal position of use of the gun. These opposite side surfaces 19 and 20 are interrupted by a recess 21 formed in each side of the gun, and by an opening 22 extending through the gun handle from one side to the other. As surface 16 extends upwardly from its lower extremity 23, this surface gradually advances forwardly, and at a location 24 commences to curve progressively forwardly at an increasing rate to ultimately merge with top surface 25 of the handle portion of the gun.

Figure 4:
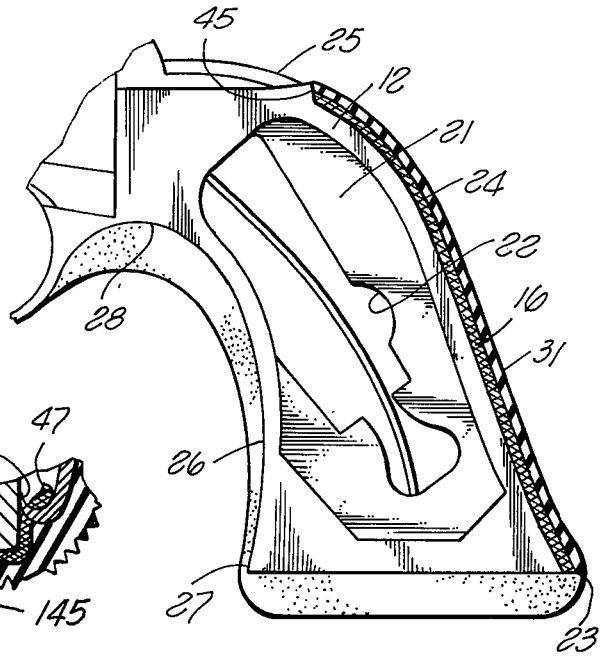
FIG. 4 is a vertical section taken on line 4—4 of FIG. 2.

The front surface 26 of the gun handle may also be curved or rounded convexly forwardly as seen in FIG. 3, in extending between the opposite side surfaces 19 and 20 of the gun handle. With reference to FIG. 4, as surface 26 advances upwardly from its lowermost extremity 27, this surface may first advance gradually rearwardly, and then curve progressively forwardly to a location 28 at which the surface is almost horizontal.

The grip device 11 with which the present invention is concerned takes the form of a unitary body of reinforced elastomeric material which completely encircles and encloses the metal handle portion 12 of the pistol, and presents resiliently deformable outer surfaces for cushioned contact with a user's hand. More specifically, the body of device 11 is molded to form two opposite side portions 29 and 30 of the device received at opposite sides of handle 12, with these side portions being interconnected integrally by a rear cross strap portion 31 extending across the back of handle 12. At the front of the handle, the molded body 11 has two flanges 32 and 33 which project inwardly toward one another and desirably into direct contact in the FIG. 3 installed position of the device, and which are received in front of the forward surface 26 of the handle. The elastomeric material 34 which forms the bulk of portions 29, 30, 31, 32 and 33 of the device may be an appropriate natural or synthetic rubber, desirably neoprene, having sufficient resilient deformability to effectively cushion the gripping contact of the user's hand with the pistol (preferably of a Shore hardness between about 33 and 45 on the A-scale). The outer surfaces of the elastomeric material may be irregularized, as by checkering or the like, across the areas of the side portions, rear portion, and front flanges.

Figure 2:
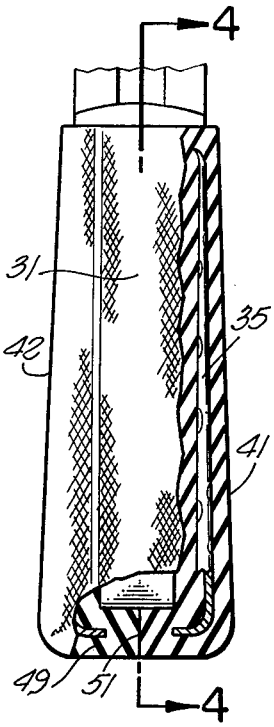
FIG. 2 is a rear view taken on line 2—2 of FIG. 1.

Side portions 29 and 30 contain, embedded within the elastomeric material of these portions, two essentially rigid preferably metal reinforcing plates 35 and 36, which may have the outline configuration illustrated at 36 in broken lines in FIG. 1, with that configuration corresponding generally to the previously discussed side view shape of handle 12 as seen in FIG. 4. Plates 35 and 36 may contain apertures 37 through which the elastomeric material may extend to assure adequate bonding of the elastomeric material to the plates. As will be understood, the side portions 29 and 30 of the grip body are mirror images of one another, as are the plates 35 and 36. The two side portions 29 and 30 contain registering apertures 38 near their centers, through which a screw 39 can extend to secure the two side sections 29 and 30 together and tightly against opposite sides of the handle 12. Plates 35 and 36 may have openings at the locations of apertures 38, so that one of the plates may engage or take the force exerted by a head of screw 39, while the other plate engages or takes the force exerted by a nut attached to the end of that screw to tightly clamp portions 29 and 30 against the gun handle. As seen in FIGS. 2 and 3, the reinforcing plates 35 and 36 are curved to be inwardly concave toward one another and toward handle 12, to follow generally and be closely proximate to the outer convexly curved surfaces 41 and 42 of the elastomeric material of portions 29 and 30. At their inner sides, side portions 29 and 30 have inner parallel planar vertical surfaces 43 and 44 which tightly engage the opposite side faces 19 and 20 respectively of handle 12.

The elastomeric material of cross strap 31 is molded integrally with and forms a continuation of the elastomeric material of the two opposite side sections 29 and 30, to permanently interconnect those sections 29 and 30 from the location of point 23 in FIG. 4 upwardly to a top extremity 45 of the cross strap. Embedded within the material of cross strap 31, adjacent rear surface 16 of the handle, the strap contains a layer of flexible reinforcing fabric 145, preferably made of nylon or the like, to enhance the integrity of the connection formed between the two side portions 19 and 20 by the cross strap. The opposite edge portions 46 and 47 of the reinforcing fabric extend laterally beyond the planes of side surfaces 19 and 20 of the handle, and extend forwardly at opposite sides of the handle within the elastomeric material of side portions 29 and 30, and are positively secured to and held in position by reinforcing plates 35 and 36 by provision on those plates of vertically spaced sharpened hook projections 48. Before molding of the rubber about the reinforcing elements, the fabric 145 is pressed against projections 48, to be pierced by those projections and secure the fabric to the plates while this assembly is placed in a mold and the elastomeric material is molded about the reinforcing parts. The hook projections 48 may for example be provided at four vertically spaced locations.

The flanges 32 and 33 at the front of the device are curved inwardly in correspondence to the horizontally curved configuration of forward surface 26 of the gun handle, to follow that curvature and closely embrace surface 26. At the upper location 28 of FIG. 4, flanges 32 and 33 may curve horizontally, in correspondence with the generally horizontal curvature of surface 26. At the bottom of the handle 12, the two opposite side sections 29 and 30 of the body of device 11 may have similar flanges 49 projecting inwardly toward one another and into engagement. The inner edge surfaces 50 of flanges 32 and 33, and two corresponding inner edge surfaces 51 of flanges 49, may all meet in a main front to rear central vertical plane 52 of the gun.

Figure 5:
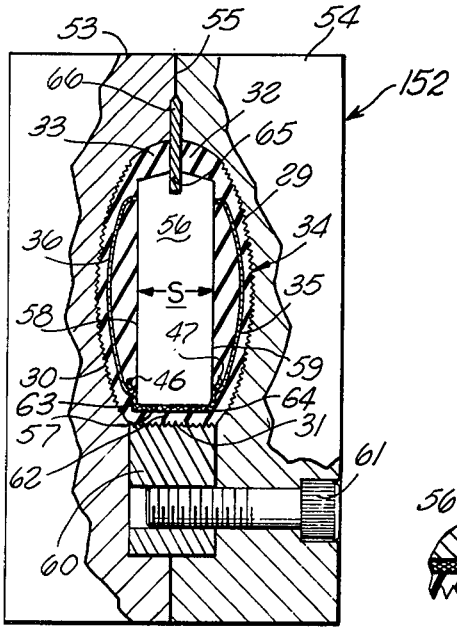
FIG. 5 is a horizontal section through a mold utilized during the manufacture of the grip of FIGS. 1 to 4.
Figure 6:
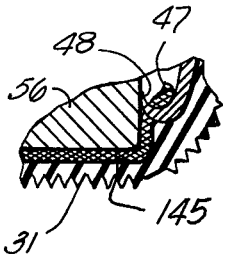
FIG. 6 is an enlarged fragmentary section showing a portion of FIG. 5.

FIG. 5 represents somewhat diagrammatically at 152 a mold which may be utilized for molding the elastomeric material of the grip device 11. This mold 152 includes two sections 53 and 54 meeting in a plane 55, and having a core 56 shaped in correspondence with the configuration of handle 12 of the gun except that the rear surface 57 of core 56 is not rounded or convexly curved in horizontal section as discussed in connection with the back surface 16 of the gun handle. Instead, as viewed in horizontal section, the surface 57 extends straight between the opposite side surfaces 58 and 59 of the core. An additional part 60 of the mold, retained by a screw or screws 61, has a checkered or otherwise irregularized surface 62 shaped generally in correspondence with the outer surface of cross strap 31 as seen in FIG. 3, except that in the mold surface 62, like surface 57, does not have a convexly curved configuration in horizontal section, but rather extends straight and parallel to surface 57 except insofar as surface 62 is irregularized. The linear distance between the points 63 and 64 in FIG. 5 is the same as the linear distance between the points 17 and 18 in FIG. 3, with the difference in curvature as discussed, so that in the mold of FIG. 5 the spacing S between the inner surfaces of side portions 29 and 30 is slightly greater than the spacing t between the surfaces 43 and 44 in FIG. 3, to leave a narrow gap 65 between the inner edge surfaces 50 of the forward flanges 32 and 33 in FIG. 5. This gap may for example be 3/64 of an inch, with a thin flat plate 66 carried by core 56 being received between projections 32 and 33 at that location to keep them separated and prevent projections from being molded integrally together at that location.

As previously indicated, the two reinforcing plates 35 and 36 and rear flexible reinforcing strap 145 (preferably pre-impregnated with uncured rubber) may first be connected together by projections 48, and then be placed in the mold of FIG. 5, with the mold then being closed so that rubber may be injected into it and molded to the illustrated configuration about the reinforcing elements. The completed structure is then removed from the mold and can be placed about handle 12 and secured thereto. As cross strap 31 is brought into engagement with the back surface 16 of the gun handle, the elastomeric material of the cross strap, which normally tends to return to the unrounded configuration of FIG. 5 because it has been molded in that shape, is pulled about and against rear surface 16 of the handle to curve in correspondence therewith as seen in FIG. 3. When the rear cross strap is thus curved, flanges 32 and 33 may be brought toward one another at the front of the handle and into position in front of and engagement with forward surface 26 of the handle. The curvature of the rear cross strap brings the opposite side portions into a closer spacing with respect to one another than that illustrated at s in FIG. 5, and is just sufficient to bring flanges 32 and 33, and bottom flange 49, into close abutting engagement at 50 and 51, thus closing the gap originally left between the flanges by provision of plate 66 on the mold core. Without illustrating the fact in detail, it will be apparent that the plate 66 carried by core 56 also has a portion which extends downwardly from the bottom of the core between the two bottom flanges 49, to maintain those flanges separated from one another during the molding operation.

When the device is in use, a person using the gun grasps the grip device 11 about handle 12, and at all locations contacts the outer resiliently deformable irregularized surface of the elastomeric material. A very effectively cushioned action is thus attained, facilitating a very positive holding and aiming of the gun and optimum control of trigger movement.

Figure 7:
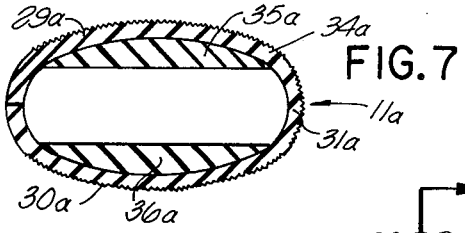
FIG. 7 is a view similar to FIG. 3, but showing a variational arrangement.

The variational arrangement of FIG. 7 may be considered the same as that of FIGS. 1 to 6 except that in lieu of the metal reinforcing plates 35 and 36 of the first form of the invention, the side portions **29*a* and 30*a* of the molded body 11*a* of FIG. 7 may have inner layers 35*a* and 36*a* of relatively hard rubber or hard resinous plastic material, bonded continuously to the outer layers 34*a* of softer elastomeric material corresponding to that utilized at 34 in FIG. 3. As an example, inner layers 35*a* and 36*a* may be hard rubber or a hard resinous plastic material having a Shore hardness of between about 90 and 100 on the D-scale, while the outer elastomeric material 34*a* may typically have a Shore hardness between about 35 and 45 on the A-scale. The hard rubber or plastic 35*a* and 36*a* then serves the purpose of the reinforcing plates of the first form of the invention, for stiffening the side portions or panels of the device 11 and forming a fairly rigid base for the elastomeric material. The cross strap 31*a* in FIG. 7 may be the same as cross strap 31 of the first form of the invention, except that the opposite edges of its reinforcing fabric 45 will of course not in this case be secured to metal reinforcing plates. The application and use of the device of FIG. 7 may be the same as that of FIGS. 1 to 6**.

While certain specific embodiments of the present invention have been disclosed as typical, the invention is of course not limited to these particular forms, but rather is applicable broadly to all such variations as fall within the scope of the appended claims.

We claim:

1. A pistol grip comprising:

a body to be received about a pistol handle;

said body including two opposite side portions adapted to be received at opposite sides respectively of the pistol handle, and a rear cross strap portion secured permanently to and connecting together said two opposite side portions at rear edges thereof and adapted to extend across the back of the pistol handle;

said body forming at least one forward flange carried by one of said side portions of the body at a forward edge thereof and projecting laterally inwardly at a location to be received in front of the pistol handle;

said body being flexible in the vicinity of said rear cross strap portion to enable movement of said flange laterally with said one side portion relative to the other side portion during application of the body to the pistol handle;

said side portions and said rear cross strap portion and said forward flange all being molded at least in part of elastomeric material to cushion contact thereof with a user's hand.

2. A pistol grip as recited in claim 1, in which said side portions include reinforcing plates embedded in and stiffening the elastomeric material of said side portions.

3. A pistol grip as recited in claim 1, in which said side portions include layers of hard rubber at the inner side of and bonded to and more rigid than said elastomeric material of said side portions to stiffen it.

4. A pistol grip as recited in claim 1, in which said cross strap portion of said body includes flexible reinforcing fabric bonded to said elastomeric material and extending across the back of the pistol handle.

5. A pistol grip as recited in claim 1, in which said side portions contain reinforcing material which is more rigid than the elastomeric material of the side portions to stiffen them, said cross strap portion including additional reinforcing material bonded to the elastomeric material of the cross strap portion and adapted to extend across the back of the pistol handle and having a flexibility greater than the reinforcing material of the side portions.

6. A pistol grip as recited in claim 1, in which said side portions contain reinforcing material which is more rigid than the elastomeric material of the side portions to stiffen them, said cross strap portion including additional reinforcing material bonded to the elastomeric material of the cross strap portion and adapted to extend across the back of the pistol handle and having a flexibility greater than the reinforcing material of the side portions, there being means attaching said reinforcing material of the cross strap portion near opposite edges thereof to said reinforcing material of the side portions.

7. A pistol grip as recited in claim 1, in which said side portions include reinforcing plates embedded within the elastomeric material of said side portions for stiffening it, said cross strap portion including reinforcing material bonded to the elastomeric material of said cross strap portion and having greater flexibility than said plates, said plates having projections extending through the reinforcing material of said cross strap portion near opposite edges thereof.

8. A pistol grip as recited in claim 1, in which said side portions of the body contain essentially rigid reinforcing plates embedded in the elastomeric material of said side portions, said cross strap portion including flexible reinforcing fabric bonded to the elastomeric material of the cross strap portion, said plates having projections extending through said cloth near opposite side edges thereof to connect the plates to the fabric.

9. A pistol grip as recited in claim 1, in which said side portions include layers of resinous plastic material at the inner side of and bonded to and more rigid than said elastomeric material of said side portions to stiffen it.

10. A pistol grip comprising:

a body to be received about a pistol handle;

said body including two opposite side portions adapted to be received at opposite sides respectively of the pistol handle, and a rear cross strap portion secured permanently to and connecting together said two opposite side portions at rear edges thereof and adapted to extend across the back of the pistol handle;

said body forming two forward flanges carried by said side portions respectively at forward edges thereof and projecting laterally inwardly toward one another at locations to both be received in front of the pistol handle in close proximity to one another;

said body being flexible in the vicinity of said rear cross strap portion to enable movement of said flanges laterally toward or away from one another during application of the body to the pistol handle;

said side portions and said rear cross strap portion and said forward flanges all being molded at least in part of elastomeric material to cushion contact thereof with a user's hand.

11. A pistol grip as recited in claim 10, in which said side portions of the body include reinforcing plates embedded in the elastomeric material of said side portions for stiffening them.

12. A pistol grip as recited in claim 10, in which said cross strap portion of said body includes flexible reinforcing cloth bonded to the elastomeric material of said cross strap portion.

13. A pistol grip as recited in claim 10, in which the elastomeric material of said body normally tends by its resilience to return to a condition in which said opposite side portions extend substantially parallel to one another in spaced relation and said cross strap portion, as viewed in horizontal section, appears straight in extending laterally from one side portion to the opposite side portion, but is deformable to a curved horizontal section to follow a correspondingly curved configuration of the back of the pistol handle.

14. A pistol grip as recited in claim 10, in which the elastomeric material of said body normally tends by its resilience to return to a condition in which said opposite side portions extend substantially parallel to one another in spaced relation and said cross strap portion, as viewed in horizontal section, appears straight in extending laterally from one side portion to the opposite side portion, but is deformable to a curved horizontal section to follow a correspondingly curved configuration of the back of the pistol handle, said flanges having inner edge surfaces which, in said condition to which the elastomeric material normally tends to return, are spaced slightly laterally apart, but which move closer together and into substantial engagement with one another when said cross strap portion is deformed to said horizontally curved configuration.

15. A pistol grip as recited in claim 14, in which said side portions of the body include essentially rigid apertured plates embedded in the reinforcing material of said side portions for stiffening them, said cross strap portion including flexible reinforcing fabric bonded to the elastomeric material of the cross strap portion and extending across the back of the pistol handle.

16. A pistol grip comprising:

a body to be received about pistol handle;

said body including two opposite side portions adapted to be received at opposite sides respectively of the pistol handle, and a cross strap portion secured permanently to and connecting together said two opposite side portions at edges thereof;

said side portions and said cross strap portion all being molded at least in part of elastomeric material to cushion contact thereof with a user's hand;

said opposite side portions of the body including essentially rigid reinforcing plates embedded in the elastomeric material of the side portions for stiffening them;

said cross strap portion including flexible reinforcing material more flexible than said plates and secured along opposite edges of the flexible reinforcing material to said plates respectively within the interior of the elastomeric material.

17. A pistol grip as recited in claim 16, including projections formed on said plates and extending through said flexible reinforcing material near opposite edges thereof to connect said flexible reinforcing material to the plates.

18. The method that comprises molding at least in part from elastomeric material a body which is to be received about a pistol handle and has two opposite side portions to be received at opposite sides respectively of the handle, and a rear cross strap portion secured permanently to and connecting together said two opposite side portions at rear edges thereof and adapted to extend across the back of the pistol handle, with said opposite side portions having surfaces to be received near the front of the pistol handle in close proximity to one another;

maintaining said body during molding in a position in which said rear cross strap portion as viewed in horizontal section is substantially straight in extending between the opposite side portions, and in which said opposite side portions are generally parallel to one another with said surfaces thereof opposite one another but spaced laterally apart a short distance;

applying said body to a pistol handle;

deforming said cross strap portion from said straight condition to a curving cross section by engagement with a correspondingly curved back surface of the pistol handle; and moving said surfaces of the opposite side portions toward one another and into more closely proximate relation than during molding by virtue of the curving deformation of the cross strap portion.

* * * * *